United States Patent [19]

Küsel

[11] Patent Number: 4,827,848

[45] Date of Patent: May 9, 1989

[54] RAILWAY PANEL REPLACEMENT METHOD AND APPARATUS WITH TEMPORARY TRACK

[75] Inventor: Peter G. Küsel, Kloof, South Africa

[73] Assignee: R A Nova Inc., London, England

[21] Appl. No.: 931,400

[22] Filed: Nov. 14, 1986

[30] Foreign Application Priority Data

Nov. 18, 1985 [ZA] South Africa ..... 85/8821

[51] Int. Cl.[4] ..... E01B 29/02

[52] U.S. Cl. ..... 104/3

[58] Field of Search ..... 104/3, 2, 243

[56] References Cited

U.S. PATENT DOCUMENTS

| | | | |
|---|---|---|---|
| 1,821,340 | 9/1931 | Guilbert et al. | 104/3 |
| 1,994,717 | 3/1935 | Köpke et al. | 104/3 |
| 4,249,467 | 2/1981 | Theurer et al. | 104/3 |

FOREIGN PATENT DOCUMENTS

| | | | |
|---|---|---|---|
| 0417412 | 8/1925 | Fed. Rep. of Germany | 104/3 |
| 2432326 | 12/1975 | Fed. Rep. of Germany | 104/3 |
| 53682 | 7/1946 | France | 104/3 |
| 1019454 | 1/1953 | France | 104/2 |
| 0658085 | 10/1986 | Switzerland | 104/2 |
| 0586220 | 12/1977 | U.S.S.R. | 104/3 |
| 767262 | 10/1980 | U.S.S.R. | 104/3 |
| 234889 | 4/1986 | U.S.S.R. | 104/3 |

*Primary Examiner*—Johnny D. Cherry
*Assistant Examiner*—Frank H. William, Jr.
*Attorney, Agent, or Firm*—Young & Thompson

[57] ABSTRACT

The invention concerns a method and apparatus for replacing railway panels, including switches by providing a pair of cars adapted to carry a temporary track, the replacement panel and gantries, the car carrying the gantries being located over the panel required to be replaced and the gantries located in position; the old panel is raised by the gantries, the temporary track is located in the vacant space and the car carrying the new panel is rolled on to the temporary track and the new panel raised by the gantries, the temporary track removed and the new panel dropped into position.

7 Claims, 6 Drawing Sheets

FIG 23
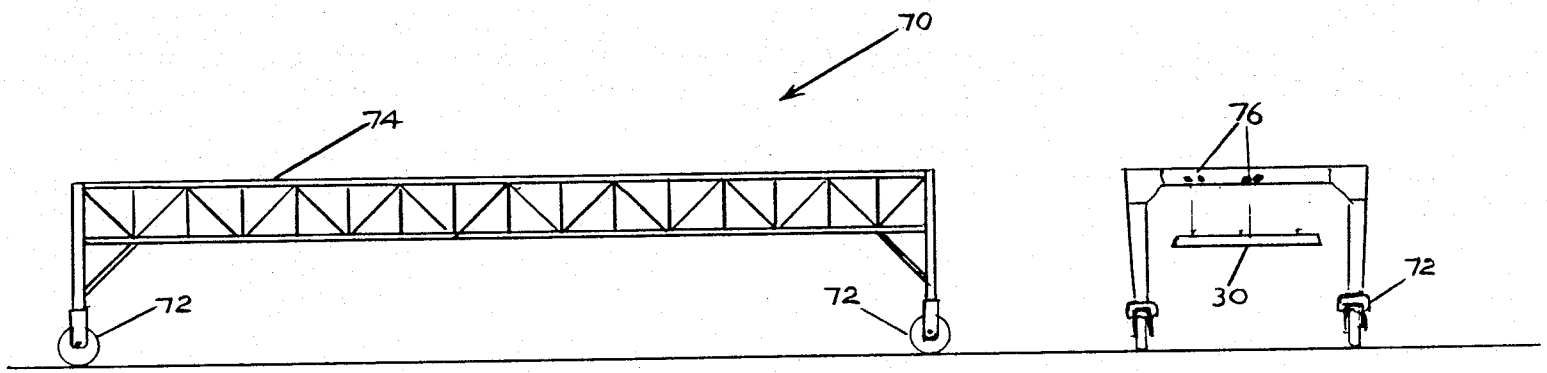
FIG 22
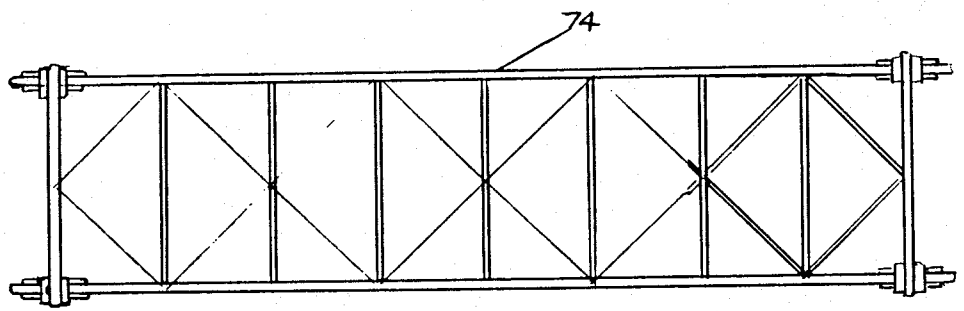
FIG 24

RAILWAY PANEL REPLACEMENT METHOD AND APPARATUS WITH TEMPORARY TRACK

FIELD OF THE INVENTION

This invention relates to the relaying of railway panels and in particular to switches or turn-outs.

BACKGROUND OF THE INVENTION

The conventional modern method of relaying switches comprises the steps of locating hydraulic lifting mechanisms over the old switch, raising the old switch, assembling and locating a temporary track in the place of the old switch, moving small trolleys on to the temporary track, lowering the old switch on to the trolleys and removing the old switch and the lifting mechanisms; followed by location of the new switch on the trolleys, relocating the lifting mechanisms (used for raising the new switch on to the trolleys), rolling in the trolleys with the new switch, raising the switch by the lifting mechanisms, removing the temporary track, lowering the new switch into position and then finally moving the lifting mechanisms.

Several disadvantages have been experienced with this method. For example, the hydraulic lifting mechanisms are required to lift very large loads and also to provide a "walking" function in order to load the new switch from a location near or adjacent the site of the old switch on to the trolleys, and also to provide adjustment of the exact location of the new switch in its final position. This latter adjustment of location has caused considerable problems and often results in a man-handling operation since the degree of adjustment is rather limited.

Another disadvantage of the conventional method is that of the necessity to remove the lifting mechanisms so that the ballast can be treated or replaced prior to laying of the new switch.

Yet another difficulty or inconvenience of the conventional method was that the new switch had to be assembled at the site or near the site of the old switch, although it has been proposed to move switches from a central manufacturing location in the vertical condition on a truck which was low enough for the upper extremity of the switch not to foul overhead lines, tunnel roofs and the like. With existing apparatus, an additional step had to be performed, namely the turning of the switch from the vertical to the horizontal position prior to location.

A search in the European Patent Office revealed the following patents:

French Pat. No. 2 325 765 (Drouard) which shows an arrangement in which a car carries a new panel and has means to support the panel in a vertical or horizontal position. The old and the new panels are conveyed on the same car.

French Pat. No. 41 694 (Collet) relates to a hoist or carrier for the old and new panels which are carried on a small carrier.

German Pat. No. 2 432 326 (Seidler) teaches the use of hoists with a series of "walkers", as described above.

French Pat. No. 2 314 299 (Profimex) requires more than two lifters and requires "walkers" as well.

U.S. Pat. No. 3 425 359 (Kawamura) also makes use of "walkers".

OBJECT OF THE INVENTION

It is an object of the present invention to simplify the method of relaying switches and panels and also to provide apparatus for carrying out the method which comprises only a fraction of the expense of prior art apparatus or conventional labor intensive method.

SUMMARY OF THE INVENTION

According to the invention, a method of replacing a railway panel (old panel) with another panel (new panel) includes the steps of (a) loading two cars with temporary tracks of standard track gauge, the new panel, and gantries, the gantries being adapted to straddle the track and being high enough when standing on the ground to permit either car to pass thereunder, off-loading the gantries over the old panel, (b) raising the old panel by means of the gantries, (c) locating the temporary track in position, (d) raising the new panel by means of the gantries, (e) removing the temporary track and (f) lowering the new panel into position.

The suspension of the new panel under the gantries enables it to be exactly located in a simple and rapid step. A final fine adjustment can be made by hand.

The height of the gantries enables work to be done to the ballast without removal of the gantries.

In a preferred form of the invention the gantries and the temporary track are carried by a second car and a new switch by a first car. The first car preferably has a low enough bed for the new switch to be transported in a vertical position, as described above. The first car is preferably provided with anchoring means which also serve to turn the new switch from a horizontal to a vertical loading position at the manufacturing, or assembling station, and to turn it from the vertical to the horizontal position at the site in either direction.

A modification of the method described above resides in the step of dropping the old switch on to the temporary track and drawing it to the side of the site remote from the second car, followed by drawing it back over the new switch when the latter has been located, raising the old switch by means of the gantries, rolling in the second car and loading the old switch thereon in a vertical position for transport away from the site.

Apparatus according to the invention includes a pair of cars adapted to transport at least a pair of gantries, temporary track of standard gauge and a new switch or panel, the gantries being demountable from the car carrying them and being adapted to straddle the panel (and temporary track).

The preferred arrangement is for a second car to transport the temporary track and the gantries and the first car to transport the new switch, preferably in the vertical position. The first and second cars may be coupled and drawn by a locomotive.

The first car may include at least a pair of pivotted arms adapted to hold the new switch in a vertical position during transport and having means, such as hydraulic means, to turn the switch between the vertical and horizontal positions on either side, and vice versa when required. As mentioned above, the first car may also be adapted to receive and transport the old switch in the same manner.

As the method of invention includes the rolling in of large cars under the gantries it is important for the temporary track to be laid as level as necessary with the existing track at either end of the switch and the method of the invention preferably includes the additional step of levelling the temporary track with the existing track, either with wedges or the like devices.

The temporary track may be of any known construction but, obviously for the operation of the present invention it must be of the same gauge as the track being replaced - i.e. it must be of standard gauge.

EMBODIMENTS OF THE INVENTION

Embodiments of the invention are described below with reference to the accompanying drawings, in which:

FIGS. 22, 23 and 24 show elevation, end view and plan of a stacking gantry respectively.

Figures 1, 2, 3, 4, 5, 6, 7:
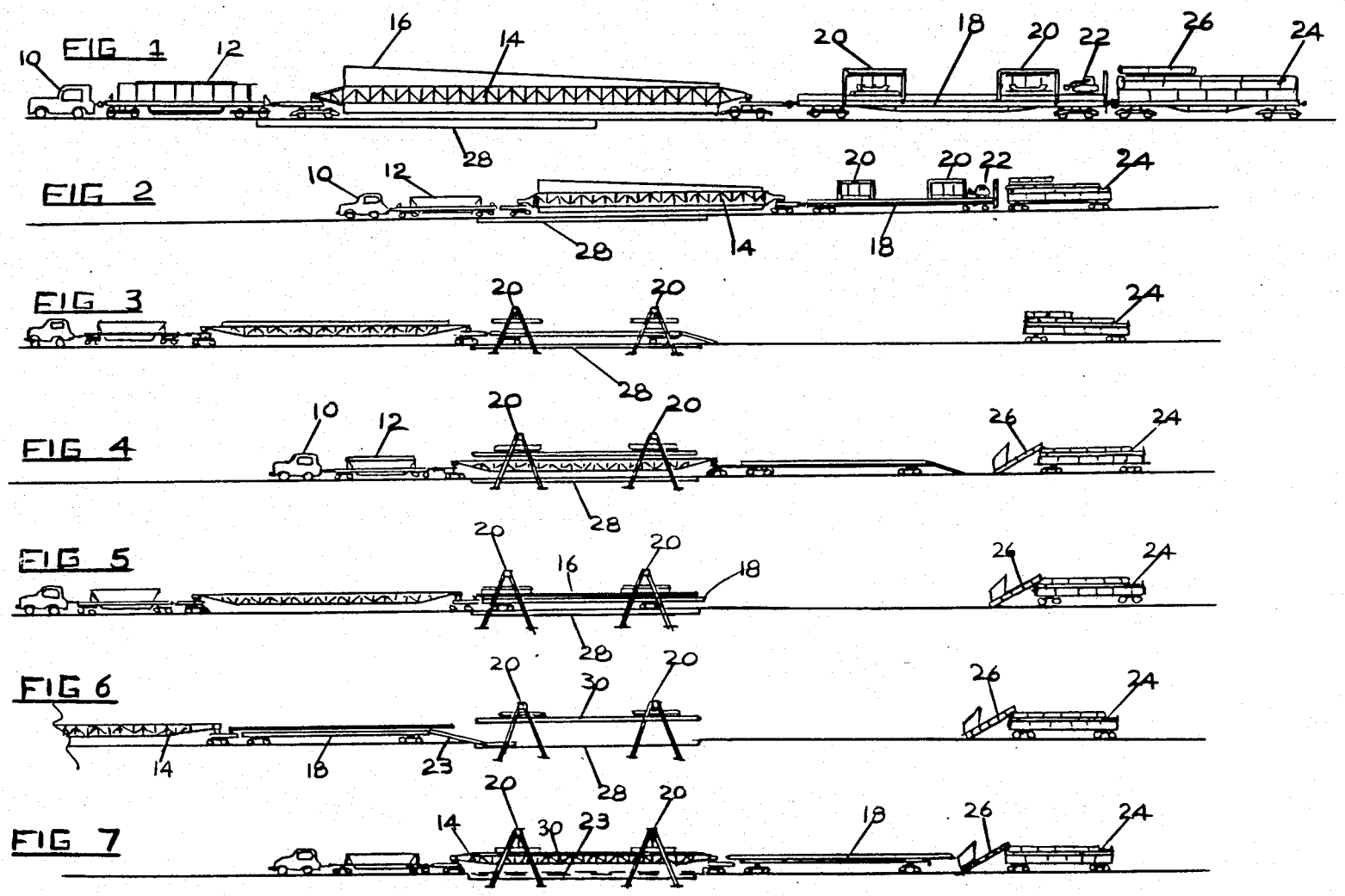
FIG. 1 is a side view of apparatus according to the invention; (NOTE: In this Figure the apparatus is drawn to a larger scale than the following twelve Figures)
FIG. 2 to FIG. 13 show the steps of the method of the invention as twelve stages.
Figures 8, 9, 10, 11, 12, 13:
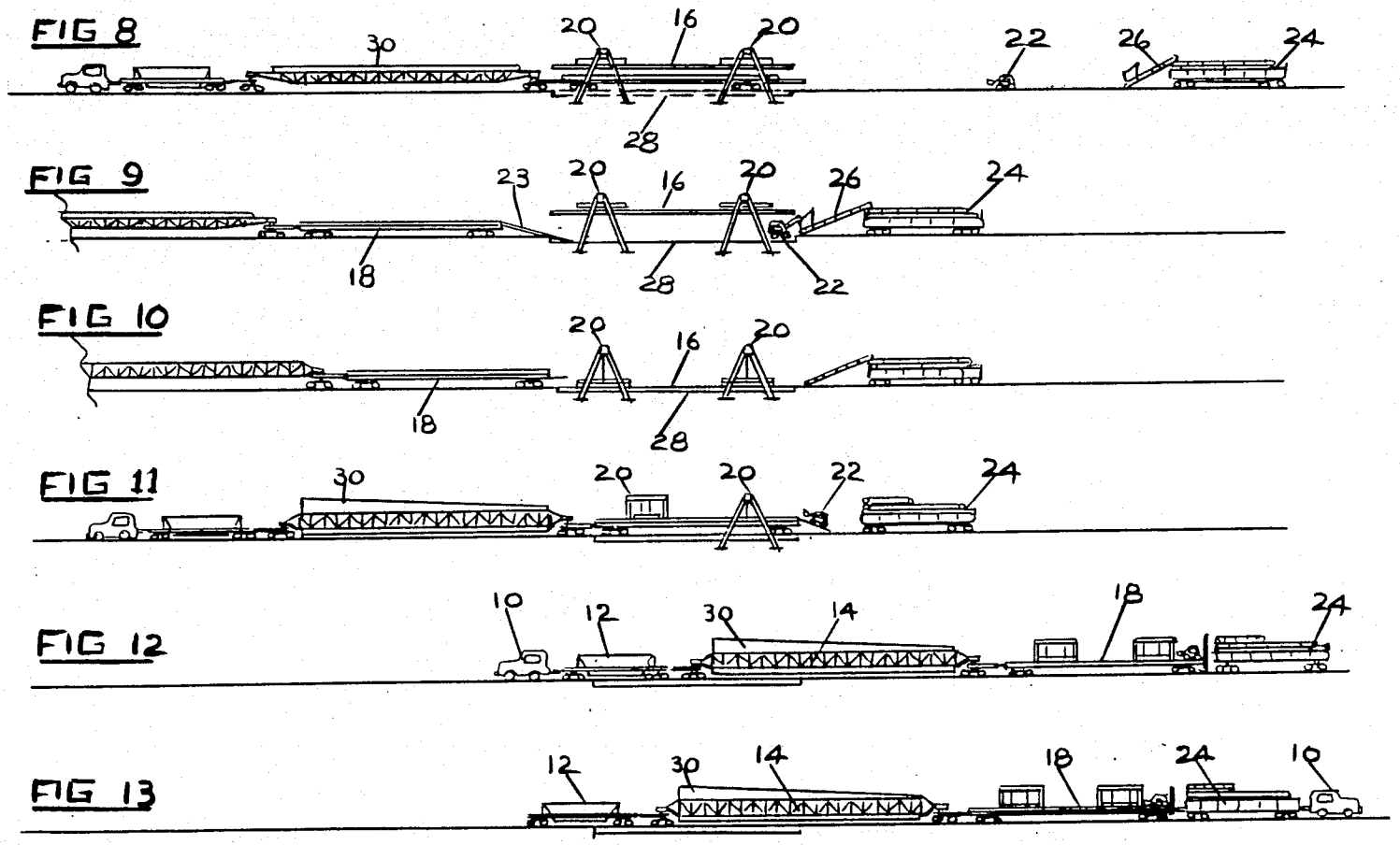
Figure 16:
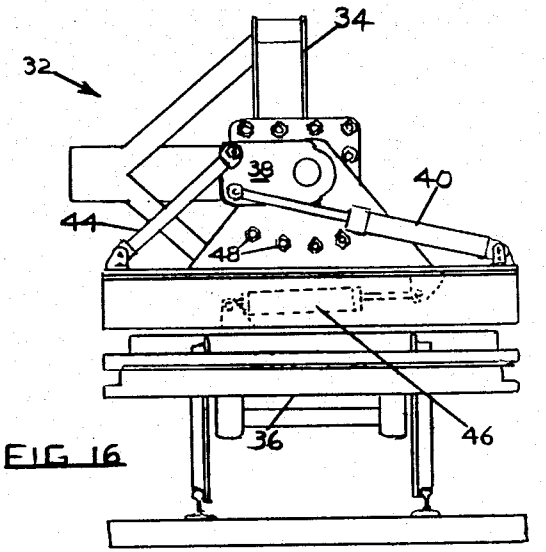
FIGS. 16 and 17 show end views of the switch turning device viewed from arrow X in FIG. 15.
Figure 17:
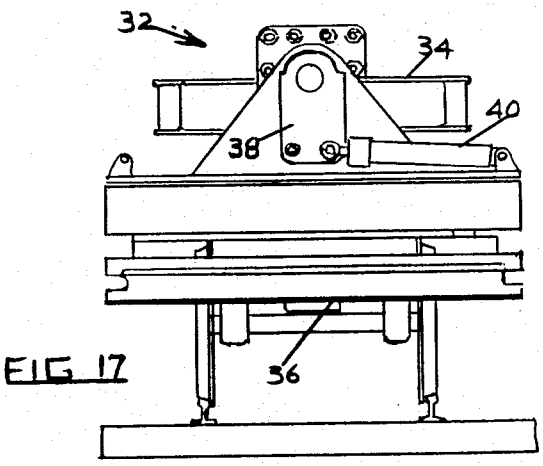
Figure 14:
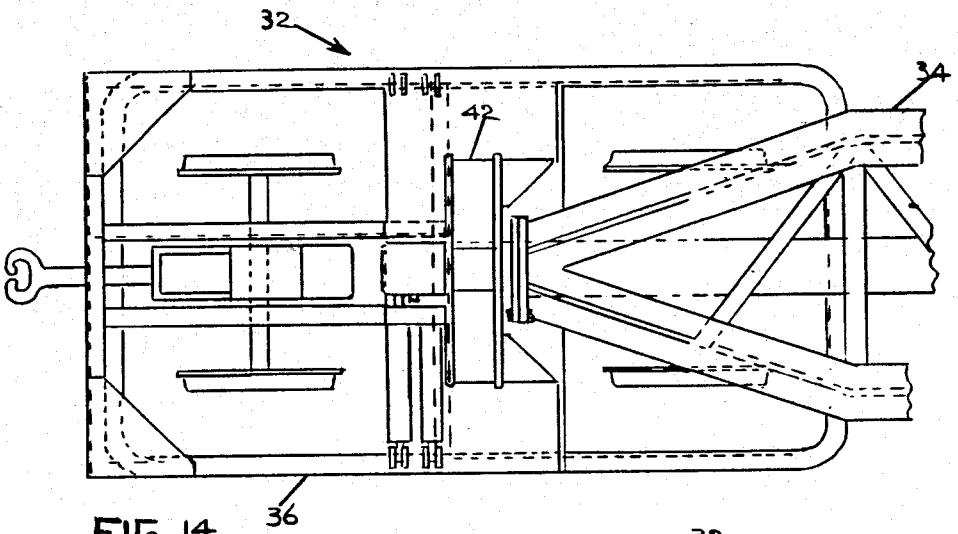
FIG. 14 and 15 show top and side views of the switch turning device.
Figure 15:
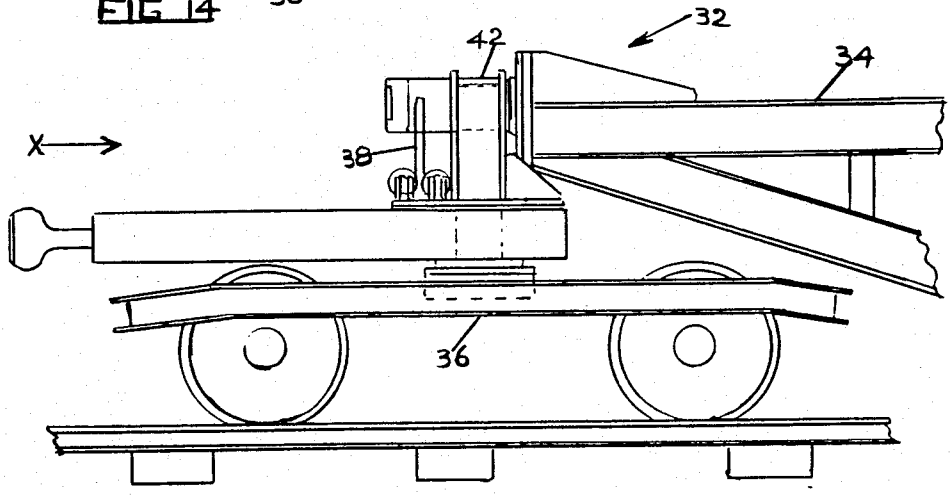

Referring to FIG. 1, the apparatus of the invention includes a locomotive 10 which draws a ballast car 12 carrying new ballast; a first car 14 carrying the new switch 16 secured in the vertical plane; a second car 18 carrying a pair of gantries 20, a payloader 22 and temporary tracks 23 and a third car 24 comprising a standard car and carrying clip-on conveyors 26.

Referring now to FIGS. 1 to 13 the steps in replacing an old switch with a new one are as follows, the steps corresponding with the successive drawings.

STEP 1

The fully loaded apparatus approaches the switch location 28.

STEP 2

Car 24 is uncoupled and located away from the switch location 28.

STEP 3

The gantries 20 are offloaded over the switch location 28, and the new switch 16 is rotated through 90° to rest in the horizontal plane.

STEP 4

Car 14 is reversed under gantries 20 and the new switch set 16 is lifted into the gantries while inclined conveyor 26 is unloaded and erected on the car 24.

STEP 5

The car 18 is placed under the gantries and the new switch set 16 is lowered onto this car.

STEP 6

Train is drawn off the switch location 28, the old switch set 30 is lifted and secured in the gantries, followed by winching the temporary track 23 into the switch location.

STEP 7

The car 14 is then placed under the gantries 20 and the old switch set 30 is lowered on to this car.

STEP 8

Car 18 is then placed under gantries 20 and the new switch set 16 is raised.

STEP 9

Train is moved off temporary track and temporary track 23 is winched back onto car 18, after which the car 24 is winched into a position closer to the switch location. The payloader 22 is then used to clear the old ballast and load it onto the conveyor 26 which in turn loads this into the car 24.

STEP 10

The new switch set 16 is then lowered into the location, secured, fishplate wedged and packed to original level. The inclined conveyor is then loaded onto car 24.

STEP 11

Car 18 is placed on new switch set, the gantries are loaded onto it, and the payloader 22 is loaded via an inclined ramp onto the same car.

STEP 12

The car 24 is then coupled to the train, whereafter the ballast car 12 is moved over the switch location 28 and the new ballast is discharged and compacted.

STEP 13

With the operation complete the locomotive turns around at nearest to crossover and proceeds with train homeward bound.

Reference to FIGS. 14, 15, 16 and 17 illustrates the mechanism 32 used to rotate the girder 34 onto which the switch (not shown) is secured for transport.

The car 14 has two bogies 36, one of which is illustrated in these drawings. These bogies are located at each end of the car and are interconnected by the girder 34 which is carried on these bogies in a massive bearing 42 designed to allow the girder to rotate through 90° in either direction, depending on whether the switch is left or right handed.

A crank 38 attached to the girder is located close to the bearing 42 and may be actuated by hydraulic rams 40 to turn through 90°. A securing link 44 is provided to lock the girder when in the transport mode. This securing link may be interchanged with the ram if the direction of rotation is reversed to the opposite handing.

A further set of hydraulic rams 46 are provided as a means to centralise the load on the car, and additional bolts 48 are also included to afford substantial locking of the turning mechanism to the bogies.

Figure 18:
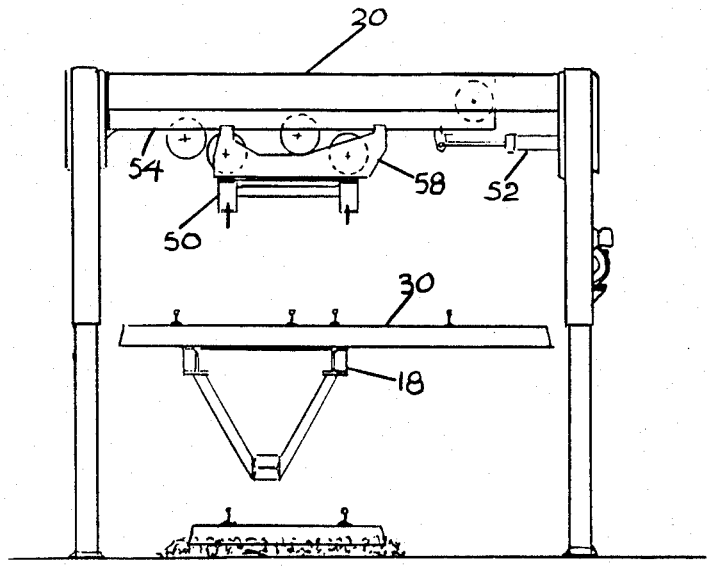
FIG. 18 illustrates an end view of a gantry.

Referring now to FIG. 18 the spreader arm 50 is shown suspended from the gantry 20 in preparation to lifting the switch 30 off a car (shown in part only) 18. The point of pick-up may be adjusted by moving the lifting tackle 54 laterally by means of the hydraulic ram 52.

Figure 19:
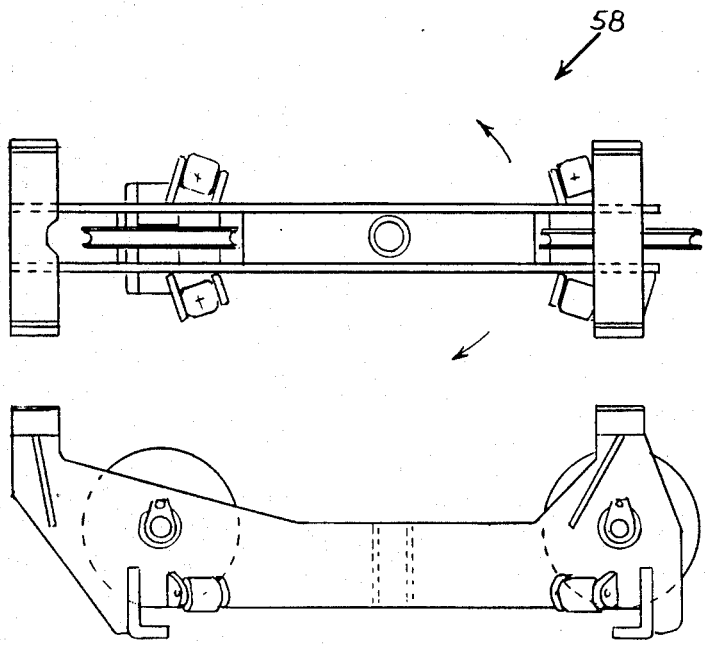
FIG. 19 shows plan and elevation of the swivelling device.

In FIG. 19 a plan and elevation shows the swivelling device 58 which forms part of the lifting tackle and allows the spreader bar to be swivelled through 90° when being altered from the travelling mode to that required for lifting.

Figure 20:
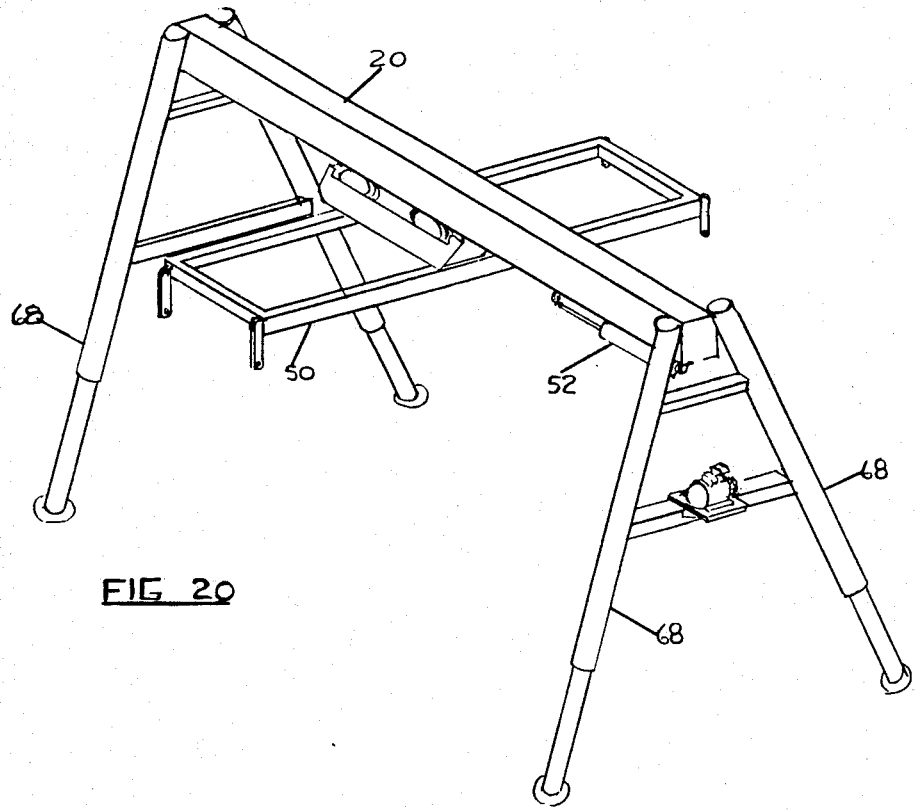
FIG. 20 shows a diagrammatic three dimensional view of one of the gantries.

FIG. 20 shows a diagrammatical three dimensional view of the one gantry 20 with the spreader bar 50 in position for pick-up.

Figure 21:
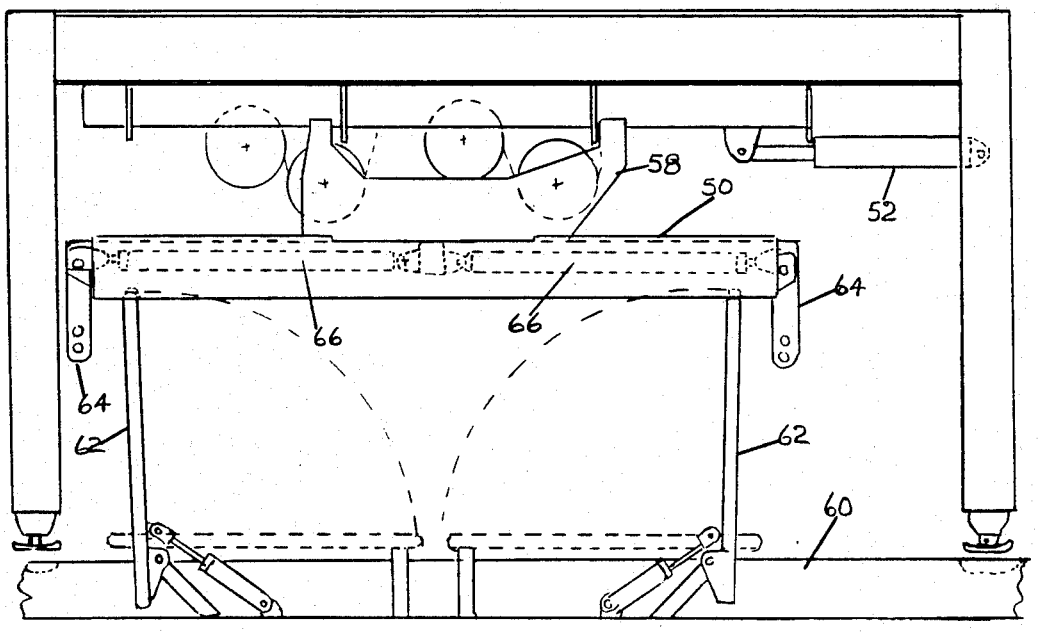
FIG. 21 illustrates an end view of the gantry.

In FIG. 21 the car bed 60 has two hydraulically operated hinged tables 62 designed to be raised to support the spreader bar 50 when required. With these plates in the lowered position as shown dotted, the lifting tackle and swivelling mechanism 58 may be lowered on to them and so lower the center of gravity for travelling. On this figure the extendable lifting members 64, of the spreader bars are actuated by hydraulic rams 66 and so provide capacity to extend the pick-up points to ensure a stable lift being accomplished. Referring again to FIG. 20 it can be readily seen how by use of the extendable spreader bar, coupled with independently adjustable gantry legs 68, and lateral adjustment ram 52, the load may be positioned with precision in all acquired dimensions, this feature being one of great benefit to effect a speedy switch replacement.

One of the important advantages of the present invention is that switches can be manufactured, assembled and stored at a central location, can then be selected depending on whether they are right or left hand switches, loaded and transported to the required site. At the central stacking location, a switch stacking and loading trolley 70 may be provided which includes pivotted wheels 72 supporting a frame 74 which has suitable lifting tackle 76 for raising the switches for instance from their position in the building jig to a temporary storage area, or for instance raising them from the storage stacks onto the car 14, and for turning them aournd 180° to face in the correct final position if necessary. Such a trolley is shown in FIGS. 22, 23 and 24.

It will be appreciated that the sequence of operations may be varied without departing from the scope of the invention. Thus, for example, the temporary track may be laid before the new panel is raised by the gantries.

I claim:

1. A method for replacing an old railway panel along a track with a new panel, including the steps of (a) loading two cars with temporary tracks of standard track gauge, gantries and the new panel, the gantries being adapted to straddle the track and being high enough that when standing on the ground they permit either car to move thereunder, (b) off-loading the gantries over the old panel, (c) raising the old panel by means of the gantries, (d) locating the temporary track in position, (e) raising the new panel by means of the gantries, (f) removing the temporary track and (g) lowering the new panel into position.

2. The method of claim 1 in which step (d) is followed by the step of locating the old panel on to a car.

3. The method of claim 1 in which step (c) is preceded by the step of transferring the new panel to the car which carried the gantries.

4. The method of claim 1 in which the gantries and temporary track are carried by a second car and the new panel by a first car, the first car being low enough for the panels to be transported in a vertical position.

5. The method of claim 1 in which step (d) is followed by the steps of lowering the old panel on to the temporary track, drawing it to the side of the site on said track remote from the car carrying the new panel, and then drawing it back on to the new switch when the latter has been located in position, raising the old panel by means of the gantries, rolling in the car which carried the new panel and loading the old switch thereon in a vertical position for transport away from the site.

6. A method according to claim 1 in which raising and lowering of the panels by the gantries is by way of flexible elements such as cables.

7. A method as defined in claim 1, wherein step (c) is preceded by the step of transferring the new panel to the car which carried the gantries.

* * * * *